United States Patent [19]

Larkins

[11] Patent Number: 4,512,330

[45] Date of Patent: Apr. 23, 1985

[54] FIREPLACE SCREEN

[75] Inventor: Bruce T. Larkins, Cookeville, Tenn.

[73] Assignee: DeSoto, Inc., Chattanooga, Tenn.

[21] Appl. No.: 460,167

[22] Filed: Jan. 24, 1983

[51] Int. Cl.[3] ..... F24C 15/12

[52] U.S. Cl. ..... 126/139; 126/285 R; 126/287; 110/176

[58] Field of Search ..... 126/121, 139, 138, 287, 126/285 R; 110/173 R, 176, 178

[56] References Cited

U.S. PATENT DOCUMENTS

| | | | |
|---|---|---|---|
| 1,148,582 | 8/1915 | Elvin et al. | 110/178 |
| 1,519,838 | 12/1924 | Horton | 110/176 X |
| 3,088,425 | 5/1963 | LaRue | 110/178 |
| 3,605,719 | 9/1971 | Andrews | 126/139 |
| 4,184,475 | 1/1980 | Faehling et al. | 126/121 |
| 4,249,510 | 12/1981 | Anderson | 126/121 |
| 4,303,056 | 12/1981 | Slavik et al. | 126/121 |

*Primary Examiner*—Larry Jones

*Attorney, Agent, or Firm*—Dressler, Goldsmith, Shore, Sutker & Milnamow, Ltd.

[57] ABSTRACT

A fireplace screen arrangement is disclosed which includes a frame upon which a pair of mesh screen doors are pivotally mounted for movement between closed and open positions with respect to the fireplace. A damper assembly is provided for regulating the amount of air which is admitted to the fireplace through the screen arrangement. In order to provide convenient opening of the screen doors, a door-opening mechanism is provided which includes a door-engaging lever fulcrummed for pivoting movement with respect to the frame. An operating knob is operatively connected with the door-engaging lever so that inward movement of the knob moves the screen doors from their closed position. In the preferred embodiment, the operating knob is operatively connected with a movable damper plate for moving the damper plate laterally to regulate air admitted through the damper assembly. In this manner, convenient use of the fireplace is enhanced, with the door-opening mechanism permitting a user to easily open the screen doors for tending the fire in the fireplace.

11 Claims, 9 Drawing Figures

FIREPLACE SCREEN

TECHNICAL FIELD OF THE INVENTION

The present invention relates generally to fireplace screens, and, more particularly, to fireplace screens in which the protective mesh is in the form of mesh doors which are openable without the intervention of a user's hands.

BACKGROUND OF THE INVENTION

With the increasing concern over energy conservation, there is a desire to minimize the amount of heated air from a dwelling that is permitted to enter a fireplace, hence to minimize room heat loss via the fireplace flue or chimney. Ideally, fireplace screens close the fireplace opening when the fireplace is not in use. Fireplace screens having a frame on which two or more glass door elements are slidably or hingedly mounted to provide access to the fireplace are therefore increasingly being used to control the draft of air entering the fireplace.

Mesh type screens, such as those of a woven metallic mesh, mounted for opening and closing like draperies are frequently provided behind firescreen glass doors to prevent flying sparks from the fireplace from escaping when the doors are open. In some cases mesh screen doors pivotally mounted on the firescreen frame are provided instead of the drapery-type mesh.

One problem with drapery type mesh screens and pivotally mounted mesh doors is that they must be hand operated to gain access to the fireplace hearth area. Thus, the user must put down logs or the like, or must leave the mesh open while gathering wood up, thus causing some inconvenience to the user and potential danger to the dwelling place.

SUMMARY OF THE INVENTION

The present invention relates to a fireplace screen having protective mesh doors which may be opened without a user's hand, i.e., without conventionally used knobs, pulls or other attaching handles. In the preferred embodiment of the invention, the door-opening mechanism is associated with an air-regulating damper assembly of the fireplace screen, thus providing the screen arrangment with conveniently operated controls which are reliable and straightforward in construction.

The present fireplace screen includes a frame which is adapted to be mounted on the face of the fireplace, and preferably includes a damper assembly on the frame to regulate the amount of air admitted to the fireplace. A pair of fireplace mesh doors are pivotally mounted on the frame for movement between closed and open positions to provide access to the fireplace area.

In order to permit convenient access to the fireplace area, the present fireplace screen includes a pivotally mounted door-opening lever which is fulcrummed on the fireplace screen frame. The lever is movable about a generally horizontal axis, and is preferably adapted to push or engage the inwardly facing surface of the mesh fireplace doors. By this action, the doors are moved from their closed position to their open position.

Pivoting movement of the door-engaging lever is provided by a operating control knob arrangement which extends through the fireplace screen frame and which is pivotally connected to the lever. In the preferred embodiment, the control knob arrangement is further operatively associated with the air-regulating damper assembly of the fireplace screen. Specifically, the control knob is operatively connected with a movable damper member which cooperates with a fixed damper member mounted on the frame for regulating the air admitted to the fireplace. The control knob is movable inwardly in order to pivot the door-engaging lever for opening the fireplace doors, with the control knob further being movable laterally or transversely of the frame for operation of the damper assembly.

The preferred construction of the present invention permits the fireplace user to easily operate the control knob for opening the fireplace doors by merely pushing the knob inwardly with their foot, thus leaving the user's hands free to tend the fire. To further enhance convenient fireplace use, the fireplace doors are preferably pivotally mounted for movement to a substantially full-open position after moved from their closed position by the door-engaging lever. To this end, the doors can be either mounted at an incline to the vertical so that they move to their full-open position under the influence of gravity, or spring biasing means can be provided for urging the doors toward their full-open position. Preferably, spring clips or like retaining means are provided for releasably retaining the doors in their closed position until they are pushed therefrom by the operating lever.

Numerous other advantages and features of the present invention will become readily apparent from the following detailed description of the invention and embodiment thereof, from the claims, and from the accompanying drawings.

DETAILED DESCRIPTION OF THE PREFERRED EMBODIMENT

Figure 1:
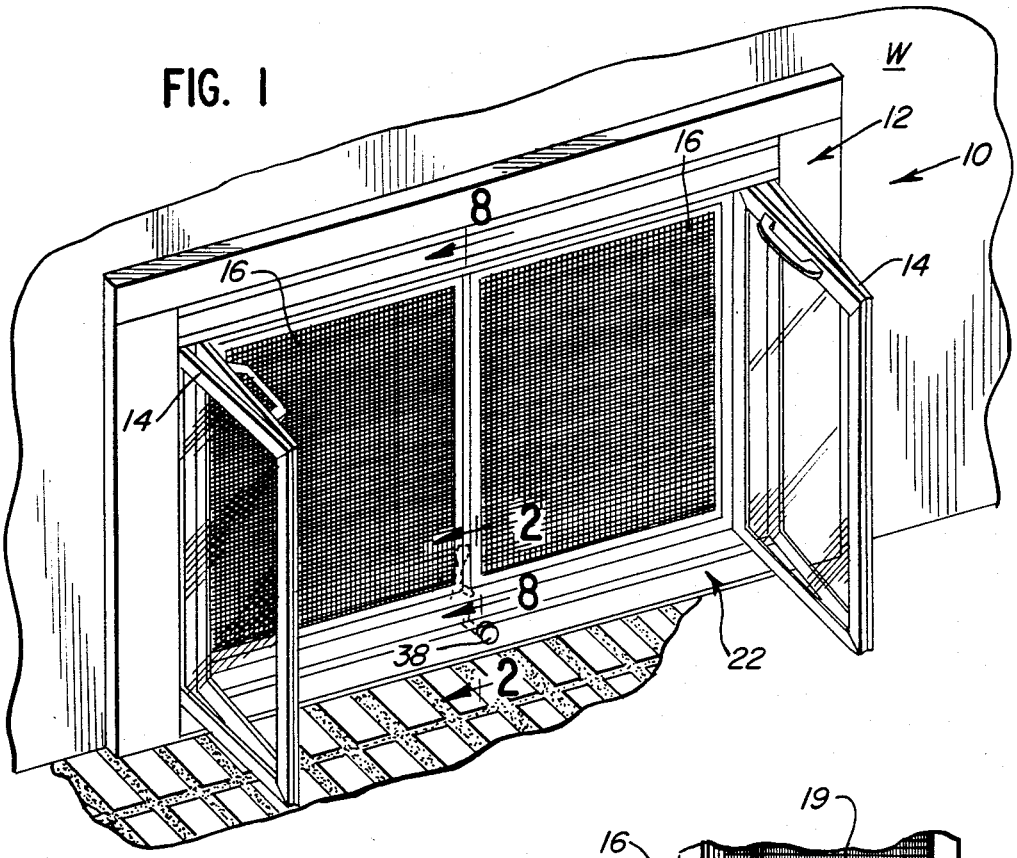
FIG. 1 is a front perspective view of a fireplace screen embodying the present invention.

While this invention is susceptible of embodiment in many different forms, there is shown in the drawings and described herein in detail one presently preferred embodiment of the invention, with the understanding that the present disclosure is to be considered as an exemplification of the principles of the invention and is not intended to limit the invention to the particular embodiment illustrated.

First referring to FIG. 1, there is shown a fireplace screen 10 that includes a frame assembly 12 on which two pairs of outwardly opening bi-fold glass doors 14 are hingedly mounted in a manner well-known to the art. Although outwardly opening bi-fold glass doors are shown, fireplace screens utilizing cabinet type doors, or sliding glass doors, among others may be used. The fireplace screen frame assembly preferably surrounds the fireplace opening and seals against the dwelling wall W around the fireplace opening, thereby to minimize the passage of air around the fireplace screen into the fireplace itself. Depending upon the frame and the surface of the dwelling wall around the fireplace, sealing materials may be disposed therebetween. Further, the fireplace screen may be physically secured to the dwelling wall in front of the fireplace, as by frame brackets which are secured to the underside of a lintel bar. When properly sealed, substantially the only air which is admitted to the fireplace itself is through the doors, when open, or through an associated damper assembly.

Figure 2:
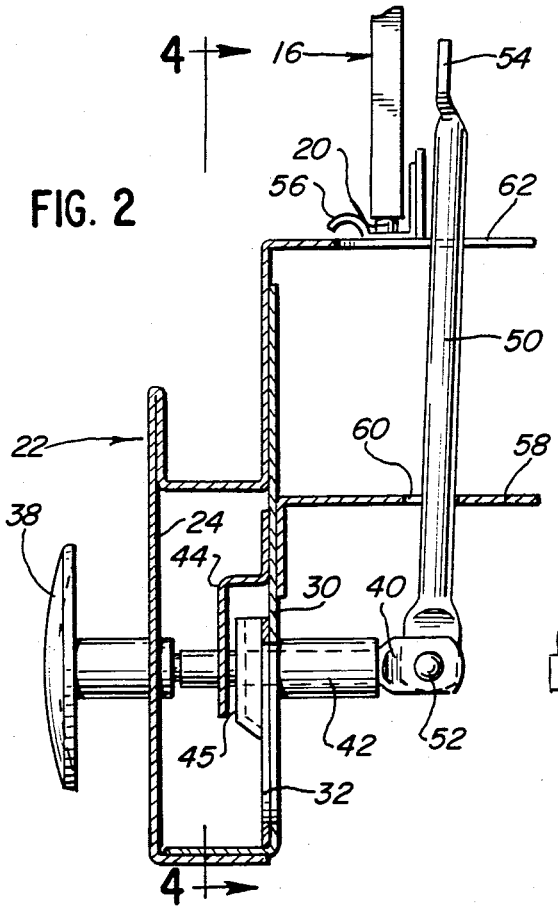
FIG. 2 is an enlarged fragmentary cross-sectional view, taken substantially along the line 2—2 of FIG. 1 showing a firescreen mesh door opening mechanism in an inactive position.
Figure 3:
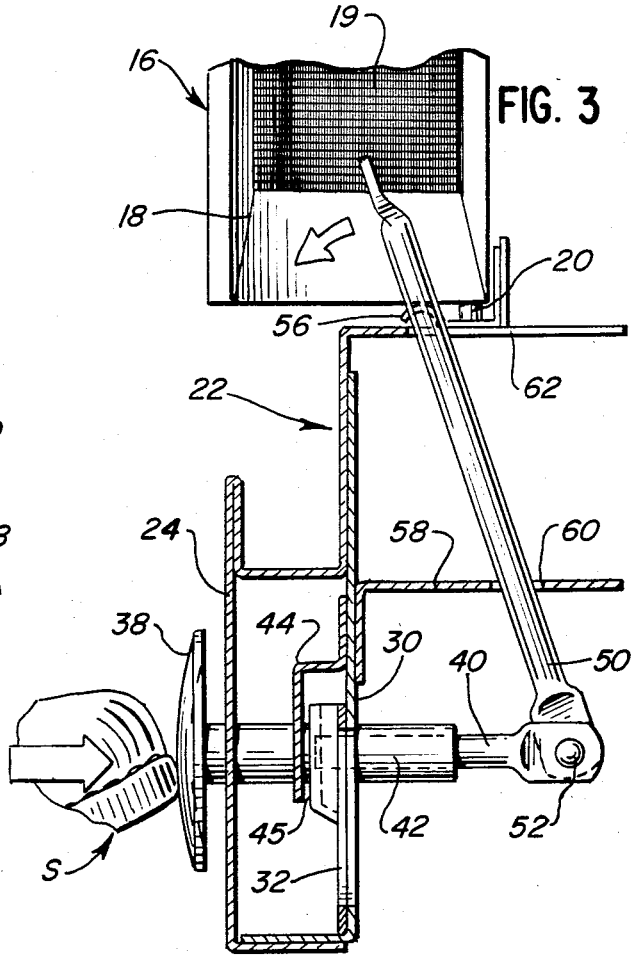
FIG. 3 is a view similar to FIG. 3 showing the opening mechanism in the active position.
Figure 8:
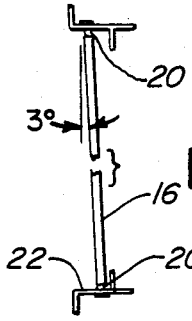
FIG. 8 is a fragmentary view taken substantially along line 8—8 of FIG. 1 illustrating a mounting arrangement for the fireplace doors which causes them to move to a fully open position.
Figure 6:
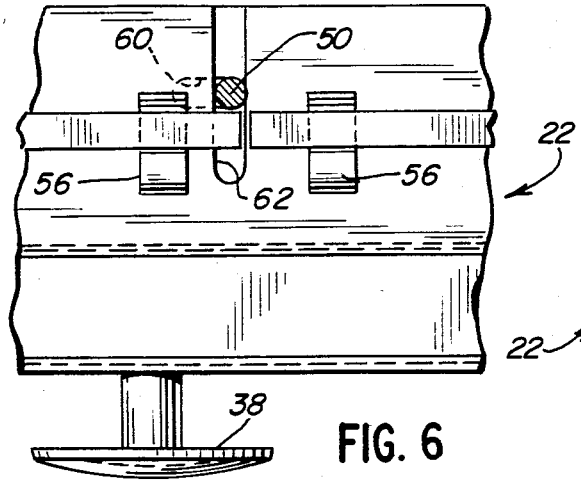
FIG. 6 is a view taken substantially along line 6—6 of FIG. 5.
Figure 7:
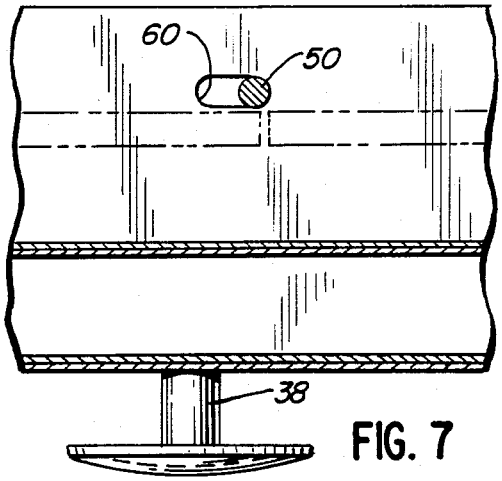
FIG. 7 is a view taken substantially along line 7—7 of FIG. 5.

In addition to the glass doors 14, protective mesh doors 16 are provided. Each such mesh door 16 comprises a suitable frame 18 for holding a mesh 19 which may desirably be wire mesh. As shown in FIGS. 2, 3, and 8, doors 16 are pivotally mounted on frame 12, as by pivot pins 20, one pivot pin at each of the top and bottom of each door 16 so that the doors may be swung from a closed position to an open position to gain access to the fireplace area.

A damper assembly is desirably positioned at the bottom of the frame, generally centrally of the fireplace screen, and is associated with frame assembly 12. The damper assembly regulates the amount of air allowed to pass therethrough to the fire. Although the damper assembly is typically located at the bottom, centrally of the fireplace screen 10, it is not limited to this specific position.

Figure 4:
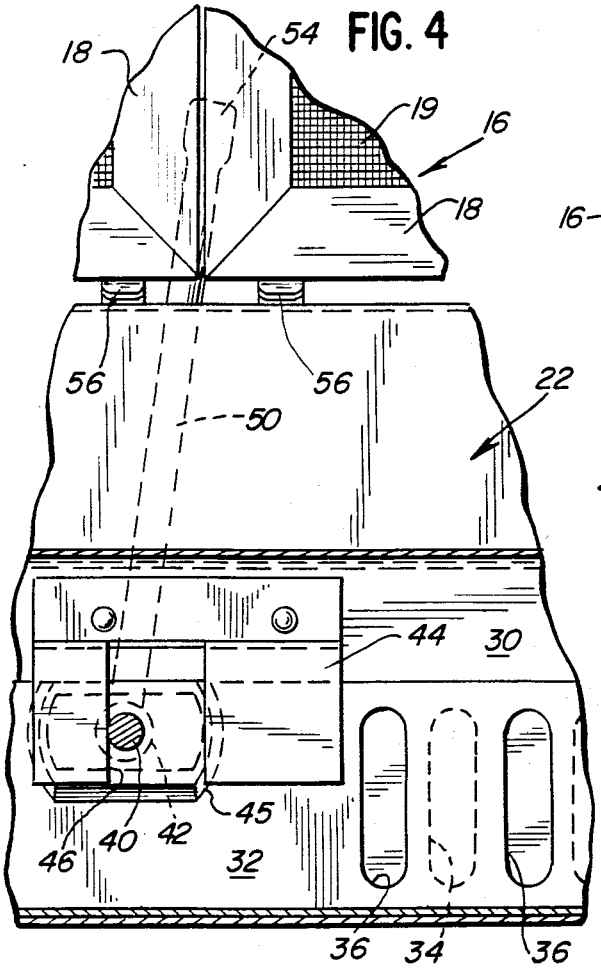
FIG. 4 is a fragmentary front view, partially in cross-section, taken along the line 4—4 of FIG. 2 with the fireplace damper assembly in a closed position.
Figure 5:
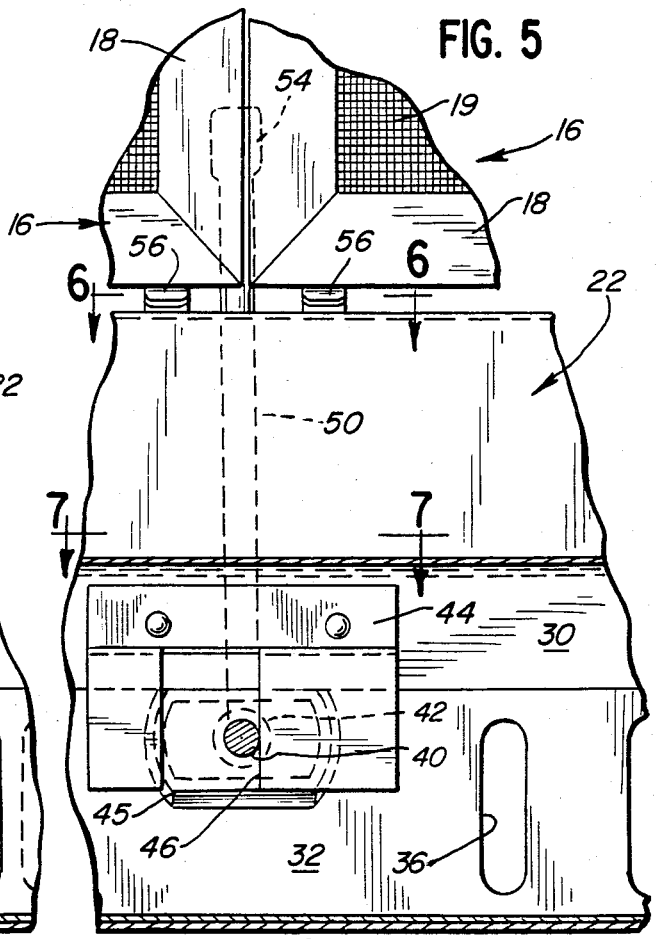
FIG. 5 is a view like that of FIG. 4 with the damper assembly in an open position.

The damper assembly is shown in greater detail in FIGS. 2 through.5 and 7. As shown in FIGS. 4 and 5, the damper assembly is mounted on a lower frame member 22 of the frame assembly 12. Member 22 includes a vertical front wall 24. The damper assembly includes an apertured, first fixed damper member or plate 30, and a second, movable damper member comprising an apertured movable damper plate 32 which is slidably movable laterally by a damper control knob 38 connected thereto. Fixed damper plate 30 is preferably positioned rearwardly of movable damper plate 32 and may comprise a portion of lower frame member 22.

The fixed damper plate 30 defines a plurality of air-admitting apertures 34, while movable damper plate 32 defines air openings 36 which are adapted for alignment with apertures 34 attendant to relative movement of movable damper plate 32 with respect to fixed damper plate 30. When movable damper plate 32 is in a first position and the apertures 34 and openings 36 of plates 30 and 32, respectively, are not in alignment (FIG. 4), a minimum amount of air is admitted therethrough to the fireplace. When damper plate 32 is in a second position and the apertures 34 and openings 36 are in alignment (FIG. 5), a maximum amount of air is admitted through the damper assembly. In this manner, the amount of air admitted can be conveniently and selectively regulated.

Movable damper plate 32 is adapted to be moved laterally by control knob 38 which is secured with an inwardly extending stem 40. Stem 40 extends through a hollow stud or collar 42 which is attached to the movable plate 32 at flange 45. Stem 40 terminates rearwardly at a pivot point with a lever 50, the purpose of which will be described hereinafter. Lateral movement of the movable plate 32 is limited by a bracket 44 which defines a notch 46 which, as seen in FIGS. 4 and 5, is positioned to engage stem 40 in the positions of movable damper plate 32 in which the apertures 34 and openings 36 are out of line (FIG. 4) and in line (FIG. 5).

In accordance with the present invention, knob 38, besides being adapted to move laterally as is conventional to align and misalign the apertures in the damper plates, is also adapted to move inwardly and outwardly, as best seen in FIGS. 2 and 3. When the knob is moved inwardly from the inactive position of FIG. 2, the stem 40 is moved to the right, carrying with it the lever 50 which is pivotally connected thereto, as by pivot pin 52. The stem 40 is guided as it moves rearwardly by the stud 42.

As seen in FIGS. 4 and 5, the frames 18 of the mesh screen doors 16 are disposed in line with the upper end 54 of the lever 50 both in the damper-open and damper-closed positions of control knob 38. Thus, when the lever 50 is moved from the inactive position of FIG. 2 to the active door-opening position of FIG. 3 by operation of control knob 38, the upper end 54 of the lever 50 contacts the doors 16 and pushes them open. Preferably, a pair of spring retainer clips 56 are provided for respective cooperation with the doors to releasably retain the doors in their closed positions.

To fulcrum the lever 50 on the frame 12, a fulcrum member such as plate 58 (suitably slotted at 60 to accommodate the necessary lateral movement of lever 50) connected to the frame 12 is provided. The lever 50 fulcrums or pivots thereabout so that the upper end 54 of the lever may move between the inactive and active positions of FIGS. 2 and 3, respectively. As the upper portion of the lever moves forwardly, the lever is guided in a guide slot 62 defined by frame member 22.

While it is presently preferred that lever 50 engage and push each of doors 16 for opening thereof, it will be appreciated that a like opening action can be provided by arranging lever 50 to push only one of the doors, with the doors associated with each other such as by a suitable plate or flange, such that pushing on one door opens both of them. Thus, the operating lever 50 is adapted to engage at least one of the doors 16, and preferably both of the doors as illustrated.

Thus, when one having opened the glass doors 14 desires to gain access to the fireplace area, even with hands full of logs or the like, the user can simply push or otherwise move the knob 38 inwardly (from left to right referring to the orientation of FIGS. 2 and 3) as with one's shoe S (FIG. 3), and the protective mesh doors 16 will be pushed open by lever 50, and will swing open about the pivot pins 20.

The doors 16 are preferably mounted for movement on frame 12 to a full-open position after release of retaining spring clips 56. For this purpose, the doors 16 are preferably mounted for pivotal movement on the pivot pins 20 at an incline to the vertical, such as at about 3° from true vertical (see FIG. 8). Thus, once the door frames 18 have passed and been released from clips 56, the doors will continue to fall open to a substantially full-open position under the influence of gravity.

Figure 9:
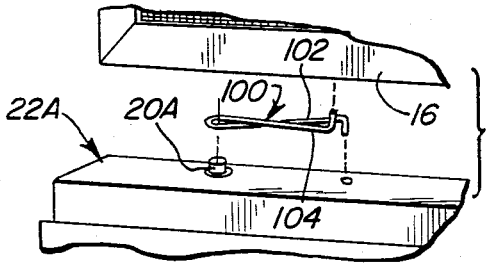
FIG. 9 is a fragmentary exploded perspective view of an alternative construction for causing the fireplace doors to open fully.

Rather than installing the doors 16 at an incline to the vertical, a wire torsion spring 100, as shown by FIG. 9, may be used around a pivot pin 20A for each door 16.

Spring 100 may have a first leg 102 fixed to the frame member 22A, and a second leg 104 adapted to bear against the rear of or otherwise engage the door frame so that when clips 56 are cleared, spring 100 will bias and urge the doors 16 to a substantially full-open position.

From the foregoing, it will be apparent that variations and modifications may be effected without departing from the true spirit and scope of this invention. It is to be understood that no limitation with respect to the specific embodiments illustrated and described herein is intended or should be inferred. It is, of course, intended to cover by the appended claims all such modifications as fall within the scope of the claims.

What is claimed is:

1. A fireplace screen having a frame adapted for association with the face of a fireplace, a damper assembly including a moveable damper member on said frame to regulate the amount of air admitted to a fireplace, and a pair of mesh doors for providing access to a fireplace area, means pivotally mounting said mesh doors on said frame, lever means on said frame for engaging the rear of at least one of said mesh doors and for pushing both of said doors open and away from the fireplace, and manual operating means comprising a damper control knob mounted on said frame and connected both to said moveable damper member and said lever means for operating said lever means to push open said mesh doors to gain access to the fireplace, and for moving said damper member.

2. A fireplace screen having a frame, a damper assembly, including a movable damper member on said frame to regulate the amount of air admitted to a fireplace, and a pair of doors for providing access to a fireplace area, means pivotally mounting said doors on said frame, lever means on said frame for engaging the rear of at least one of said doors for pushing said doors open and away from the fireplace, operating means on said frame for operating said lever means to open said doors, said operating means comprising a damper control knob connected to said movable damper member, said damper assembly further comprising a fixed damper plate, and wherein said movable damper member comprises a movable damper plate, said damper knob being connected to said movable damper plate for movement of said movable damper plate relative to said fixed damper plate, and said damper knob being movable inwardly relative to said movable damper plate for operating said lever means.

3. A fireplace screen having a frame, a damper assembly including a movable damper member on said frame to regulate the amount of air admitted to a fireplace, and a pair of doors for providing access to a fireplace area, means pivotally mounting said doors on said frame, lever means on said frame for engaging the rear of at least one of said doors for pushing said doors open and away from the fireplace, operating means on said frame for operating said lever means to open said doors, said operating means comprising a damper control knob connected to said movable damper member, and including means for fulcruming said lever means on said frame, whereby when said lever means is operated by said operating means, said lever means pivots about said fulcrum means to engage and push open said pair of doors.

4. A fireplace screen in accordance with claim 3, further including means for releasably retaining said doors in a closed position, said mounting means mounting said doors for movement to substantially a full-open position when said lever means pushes said doors for release from said retaining means.

5. A fireplace screen in accordance with claim 4, wherein said mounting means comprise pivot means mounting said doors at an incline to the vertical so that said doors move by gravity to said full-open position.

6. A fireplace screen in accordance with claim 4, wherein said mounting means comprise spring means for biasing said doors towards said full-open position.

7. A fireplace screen having a frame and a damper assembly mounted thereon to regulate the amount of air admitted to a fireplace in a dwelling, comprising:

a first fixed damper member having a plurality of apertures, a second movable damper member having a plurality of openings adapted for alignment with said apertures, a damper control mounted on said frame and movable laterally of said frame for moving said second damper member relative to said first damper member, said second damper member being slidably movable between a first position in which said apertures and said openings are not in alignment so that a minimum amount of air is admitted through the damper assembly to said fireplace, and a second position in which said apertures and said openings are aligned so that a maximum amount of air is admitted through the damper assembly to said fireplace, mesh doors pivotally mounted on said fireplace screen, means for opening said mesh doors including means for engaging at least one of said doors for moving them from a closed position to an open position, said opening means being operatively associated with said damper control, said damper control further being mounted for movement inwardly of said frame to move said engaging means to open said doors.

8. A fireplace screen in accordance with claim 7, wherein said engaging means comprises lever means pivotally connected to said damper control, said lever means being fulcrummed on said frame for movement by said damper control to move said doors from said closed position to said open position.

9. A fireplace screen in accordance with claim 7, including means for releasably retaining said doors in said closed position.

10. A fireplace screen in accordance with claim 9, and means pivotally mounting said doors at an incline to the vertical so that said doors move to a full-open position by gravity after release of said retainin means.

11. A fireplace screen in accordance with claim 9, including spring biasing means for biasing said doors to a full-open position after release of said retaining means.

* * * * *